United States Patent [19]

Rhine

[11] Patent Number: 4,640,515

[45] Date of Patent: Feb. 3, 1987

[54] MECHANICAL ROPING STEER

[76] Inventor: Art Rhine, Box 1278, Pampa, Tex. 79065

[21] Appl. No.: 827,735

[22] Filed: Feb. 10, 1986

[51] Int. Cl.[4] ..... A63B 69/00

[52] U.S. Cl. ..... 273/339

[58] Field of Search ..... 273/339, 338, 336, 359

[56] References Cited

U.S. PATENT DOCUMENTS

| | | | |
|---|---|---|---|
| 518,930 | 4/1894 | Allen | 273/336 |
| 2,560,657 | 7/1951 | Nogle . | |
| 2,819,900 | 1/1958 | Brackett . | |
| 2,846,810 | 5/1957 | Ory . | |
| 3,716,941 | 2/1973 | Dowden et al. . | |
| 3,776,553 | 12/1973 | Kelton | 273/339 |
| 3,802,706 | 4/1974 | Hamm | 273/339 |
| 4,136,874 | 1/1979 | McCord | 273/339 |
| 4,266,779 | 5/1981 | English | 273/359 |
| 4,451,045 | 5/1984 | Fesmire | 273/338 |

*Primary Examiner*—William H. Grieb

*Attorney, Agent, or Firm*—James E. Bradley

[57] ABSTRACT

A practice unit for rodeo performers allows the performers to practice team steer roping. The practice unit has a longitudinal frame member with rear legs pivotally mounted on the end. Horns are located on the other end of the longitudinal frame member. The longitudinal frame member is supported on the forward end by a support member which anchors to the ground. The support member inlcudes a coil spring that allows flexing when the horns are roped and pulled sideways repeatingly. The flexing movement causes the legs to pivot forwardly when the horns are roped, allowing the other performer to rope the legs.

6 Claims, 4 Drawing Figures

MECHANICAL ROPING STEER

BACKGROUND OF THE INVENTION

1. Field of the Invention

This invention relates in general to devices for enabling persons such as rodeo performers to practice roping, and in particular to a practice unit for practicing head and heel team roping.

2. Description of the Prior Art

In one rodeo event, a team of two performers on horseback attempts to rope a steer in a minimum amount of time. One member of the team will rope the horns of the steer from one side. Then, his horse will turn, pulling the steer's head to one side. Immediately after the first performer ropes the horns, the second performer will as soon as possible rope the heels, or both hooves of the rear legs. The second rider's horse will then stop, immobilizing the steer.

To acquire skill in this event takes a lot of practice. Mechanical roping units for roping practice in general are available. In some, the unit consists of a stationary frame with a head or set of horns on the front. In others, the frame may be movable on wheels. One unit has a motor that cycles rear legs up and down to enable one to practice roping the heels. However, the heels cycle at a uniform speed, thus do not accurately portray the uncertainty of movement of a steer being roped.

SUMMARY OF THE INVENTION

A practice unit is provided particularly for use in team steer roping. This unit has a longitudinal frame member with rear legs mounted at the rear. The rear legs are mounted for free pivotal swinging movement. Horns are mounted on the front of the longitudinal frame member. A forward support member is mounted between the horns and the rear legs. This forward support member supports the forward end. The forward support member has flexibility in it so that when the horns are roped, it will allow the longitudinal frame member to pivot, raising the rearward end, and allowing the rear legs to swing forwardly. The flexible forward support member also allows some twisting action of the longitudinal frame members so that one rear leg may pivot at a higher elevation than the other, to simulate actual occurrences.

DESCRIPTION OF THE PREFERRED EMBODIMENT

Figure 1:
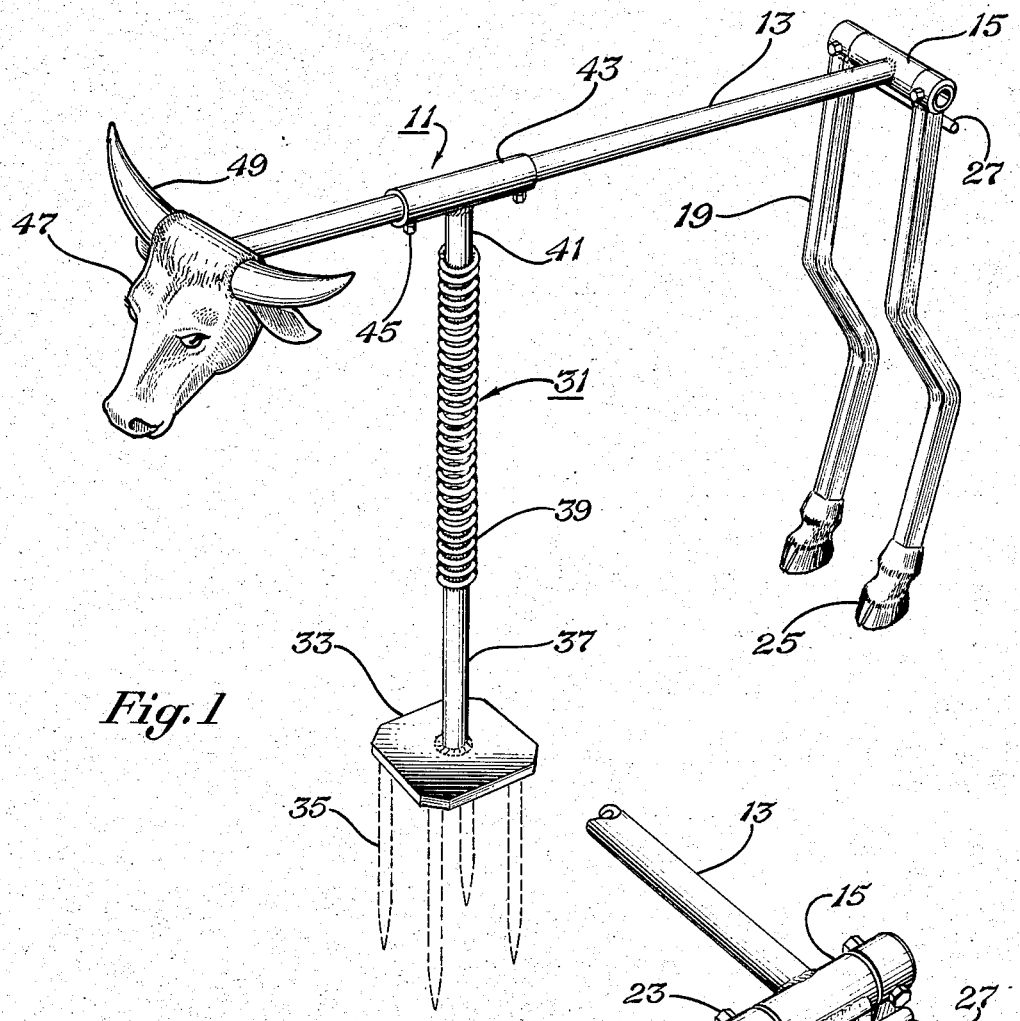
FIG. 1 is a perspective view of a practice unit constructed in accordance with this invention.

Referring to FIG. 1, the mechanical steer or practice unit 11 is constructed for practicing team roping of heads and heels. Unit 11 includes a longitudinal frame member 13. The longitudinal frame member 13 is a metal tube that simulates the backbone of a steer. Longitudinal frame member 13 will incline upwardly slightly, from the rearward end to the forward end, when the unit is stationary. A transverse tube 15 is mounted to the rearward end of the longitudinal frame member 13 transverse to the axis of the longitudinal frame member 13.

Figure 2:
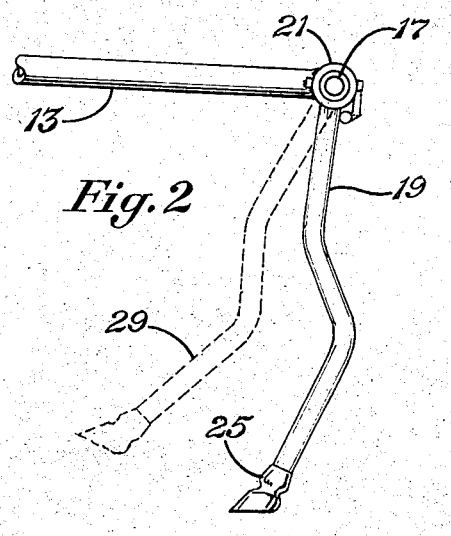
FIG. 2 is a partial side view of the rear legs of the unit in FIG. 1.
Figure 3:
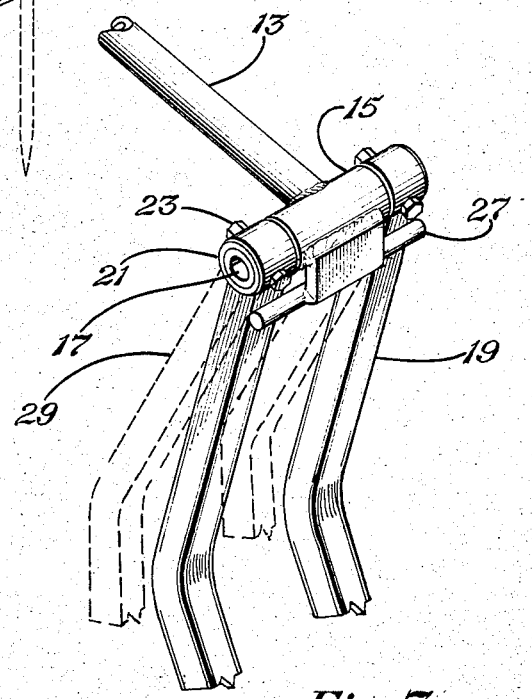
FIG. 3 is an enlarged partial perspective view of the rear legs of the unit of FIG. 1.

As shown also in FIGS. 2 and 3, a shaft 17 extends through the tube 15. Shaft 17 is freely rotatable in the tube 15. Shaft 17 is a hollow tubular member, and its ends protrude from the tube 15 on each side.

A pair of rear legs 19 are mounted to each protruding end of the shaft 17 for movement therewith. Each rear leg 19 has a sleeve 21 on its upper end that slides over the shaft 17 and is secured to it by a bolt 23. Each rear leg 19 is a tubular member that is curved to simulate the rear leg of a steer. A facsimile of a hoof 25 is located on the lower end of each rear leg 19.

A stop member 27 is mounted to the rear side of the transverse tube 15. Stop member 27 comprises a pair of bars, each of which extend along an axis that is perpendicular to the axis of the longitudinal frame member 13. The stop member 27 is positioned to prevent the rear legs 19 from moving any farther rearwardly than the upright position shown in FIGS. 1 and 2. In this position, the legs 19 are in the normal position of the legs of an actual steer when standing. In this position, the hooves 25 will be located slightly forward of a vertical line extending through the sleeve 21. As shown by the dotted lines 29, if raised above the ground and tilted forwardly, the rear legs 19 are free to pivot or swing forwardly in a vertical plane that is parallel with a vertical plane passing through the longitudinal frame member 13. The rear legs 19 pivot in unison with each other.

A forward support member 31 is located generally where the front legs of an actual steer would be located. The forward support member 31 includes a base 33 which is adapted to contact the ground. Base 33 is a flat plate located in a horizontal plane. Preferably, the base 33 will have some stakes 35 or sharp pointed members that protrude downwardly. The stakes 35 serve as means to anchor the base 33 to the ground.

A lower tube 37 extends upwardly from the base 33 a short distance. The forward support member 31 includes flexible means for allowing the foward support member to flex forwardly and laterally. A coil spring 39 serves as the flexible means. It has its lower end rigidly mounted to the lower tube 37. The upper end of coil spring 39 is rigidly mounted to a short upper tube 41. The coil spring 39 is of slightly larger diameter than the tubes 37 and 41. Its length comprises a substantial part of the length of the forward support member 31, at least more than half. The length of the forward support member 31 is selected so as to position the longitudinal frame member 13 at a slight inclination relative to the base plate 33 when the rear legs 19 are resting on the ground.

The upper tube 41 depends downwardly from a sliding sleeve 43. Sliding sleeve 43 will slide along the longitudinal frame member 13. Set screws 45 can be used to fix the sleeve 43 at the desired position along the length of the longitudinal frame member 13.

A head or horn member 47 is secured to the forward end of the longitudinal frame member 13. Head member 47 may be shaped in the form of a steer's head, and will preferably be formed of a plastic or fiberglass. A pair of horns 49 extend outwardly from the head 47 on each side.

The overall length of the longitudinal frame member will be approximately that of an average steer. The legs 19 and forward support member 31 are preferably shorter than the legs of an actual steer to produce about the same perspective to a person on foot as when on horeseback. This allows the performers to practice on foot.

In operation, the stakes 35 will be pressed into the ground until base 33 contacts the ground. The hooves 25 will initially be resting on the ground. One member of the team will approach the practice unit 11 from one side and will rope the horns with the rope 51, as shown if FIG. 4. He will then repeatingly pull sharply to the side and forwardly. This jerking movement causes the coil spring 39 to flex to one side and also to bend forwardly. The forward support member 31 thus becomes a fulcrum, causing the rear end of the longitudinal frame member to pivot upwardly some. The longitudinal frame member 13 will also twist some due to the pulling of the head 47 to one side. The flexing causes the rear legs 19 to swing forwardly soley under the force of gravity, as indicated by the dotted lines 29 in FIGS. 2 and 3. The hooves 25 will also swing outwardly a little, providing access for a heel rope 53.

Figure 4:
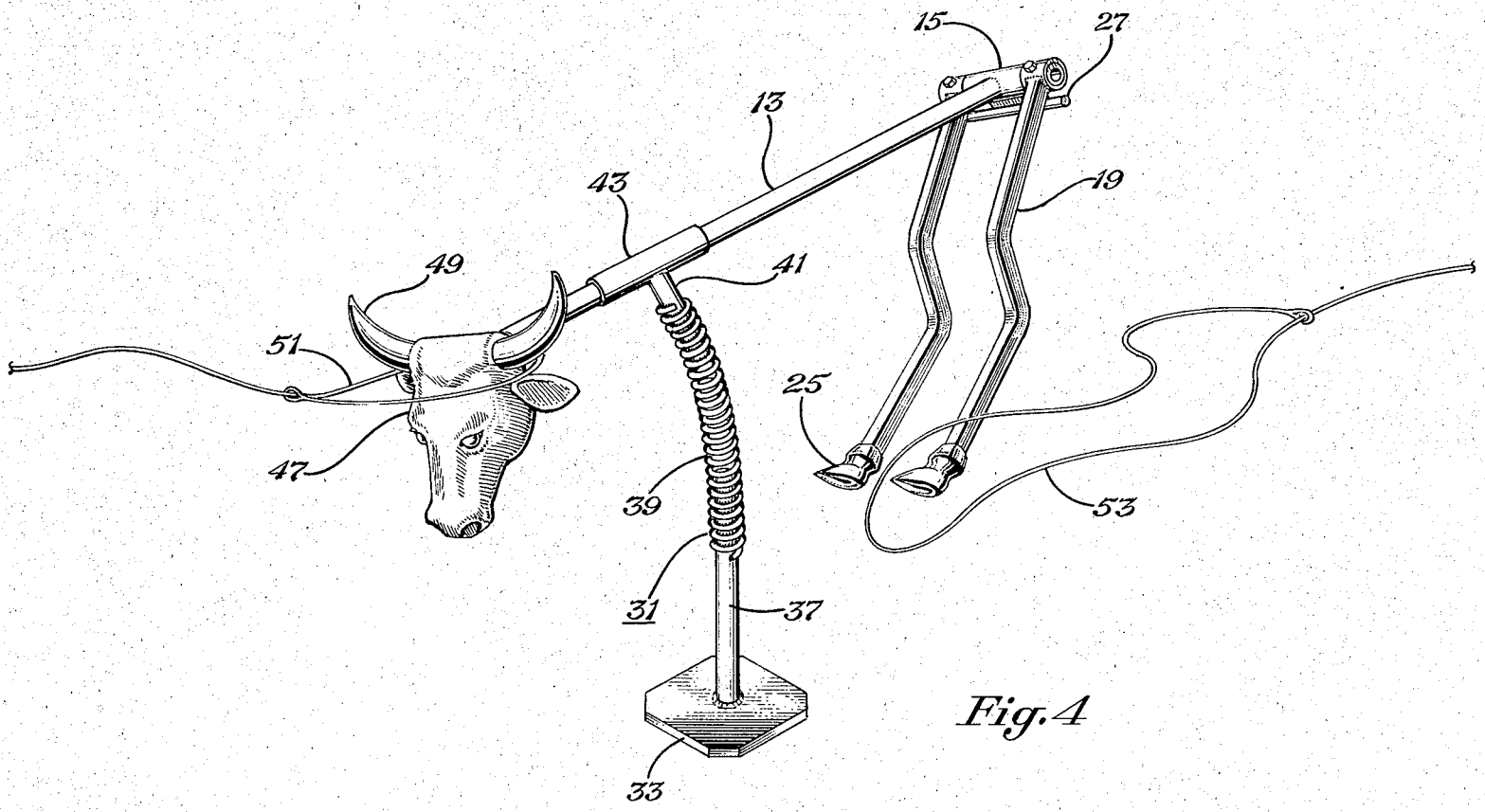
FIG. 4 is a perspective view of the unit of FIG. 1, shown being roped.

The repeated jerking movement by the first rope 51 causes the rear legs 19 to bounce up and down and swing forwardly and rearwardly between an upright position as shown in FIG. 1 and a forward position as shown in FIG. 4. The forward and rearward swinging movement is soley under the force of gravity. This simulates the normal rear leg movements of a steer being roped, and enables the other team roper to use his rope 53 to rope the rear legs 19 from the side opposite from head rope 51. The heel rope 53 must be thrown while the legs 19 are swinging fowardly.

The invention has significant advantages. The practicing unit closely simulates the movement of a steer which occurs when being team roped. The pivotal bouncing movement of the legs which occurs when the horns are roped and repeatingly pulled to one side simulates actual movement. This provides good training in timing and accuracy for the heel roper. The device is simple and inexpensive. The device will require little maintenance, and uses no electrical components.

While the invention has been shown in only one of its forms, it should be apparent to those skilled in the art that it is not so limited but is susceptible to various changes without departing from the scope of the invention.

I claim:

1. An apparatus for use in practicing team steer roping, comprising in combination:

a longitudinal frame member;

a pair of rear legs;

mounting means for mounting the upper ends of the legs to the rearward end of the longitudinal frame member to allow pivotal swinging movement of the legs relative to the longitudinal frame member, the legs having lower ends adapted to contact the ground to support the rearward end of the longitudinal frame member;

a pair of horn members mounted to the forward end of the longitudinal frame member;

a forward support member having an upper end connected to the longitudinal frame member between the horn members and the legs, and a lower end adapted for contact with the ground to support the forward end of the longitudinal frame member; and flexible means in the forward support member for allowing the forward support member to flex forwardly and laterally when the horn members are roped and pulled sideways repeatingly, for causing the lower ends of the legs to repeatingly raise above the ground and pivot forwardly, to position the lower ends of the legs for roping.

2. The apparatus according to claim 1 wherein the mounting means allows the legs to swing freely forward and rearward solely under the force of gravity when the horn members are roped and repeatingly pulled sideways.

3. The apparatus according to claim 1 wherein the mounting means comprises:

a sleeve mounted to the rearward end of the longitudinal frame member transverse to the longitudinal frame member;

a shaft extending through the sleeve and being freely rotatable relative to the sleeve;

the upper end of each leg extending downwardly from the shaft on opposite sides of the sleeve for movement therewith.

4. An apparatus for use in practicing team steer roping, comprising in combination:

a longitudinal frame member having a longitudinal axis;

a pair of rear legs;

mounting means for mounting the upper ends of the legs to the rearward end of the longitudinal frame member to allow unrestricted pivotal swinging movement relative to the longitudinal frame member in a plane that is substantially parallel with the longitudinal axis of the longitudinal frame member, the legs having lower ends adapted to contact the ground to support the rearward end of the longitudinal frame member;

a pair of horn members mounted to the forward end of the longitudinal frame member;

a base adapted to be placed on the ground; and a coil spring having a lower end connected to the base and an upper end connected to the longitudinal frame member between the horn members and the legs for allowing the horn members to shift forwardly and laterally when roped and pulled sideways and forwardly, to cause the rear legs to pivot forwardly for positioning for roping.

5. The apparatus according to claim 4 further comprising at least one stake extending downwardly from the base for piercing the ground to anchor the base to the ground.

6. An apparatus for use in practicing team steer roping, comprising in combination:

a longitudinal frame member having a longitudinal axis;

a sleeve mounted to the rearward end of the longitudinal frame member transverse to the longitudinal axis of the longitudinal frame member;

a shaft extending rotatably through the sleeve;

a pair of rear legs, each having an upper end extending downward from one end of the shaft on opposite sides of the sleeve, to allow forward pivotal swinging movement of the legs in planes substantially parallel with the longitudinal axis of the longitudinal frame member;

stop means mounted to the rearward end of the longitudinal frame member to prevent rearward swinging movement of the legs past an upright position;

a pair of horn members mounted to the forward end of the longitudinal frame member;

a base;

anchor means for anchoring the base to the ground;

a coil spring connected between the base and the longitudinal frame member between the shaft and the horn members, for allowing the horn members to shift fowardly and laterally when roped and pulled repeatingly by a first roper forwardly and laterally, to cause the rear legs to pivot back and forth to position the legs for roping by a second roper.

* * * * *